US005264007A

United States Patent [19]

Lask

[11] Patent Number: 5,264,007

[45] Date of Patent: Nov. 23, 1993

[54] METHOD OF MAKING FUEL BRIQUETTES AND THE BRIQUETTES SO MADE

[75] Inventor: Gert-Wilhelm Lask, Berus, Fed. Rep. of Germany

[73] Assignee: Applied Industrial Materials Corporation - AIMCOR, Deerfield, Ill.

[21] Appl. No.: 551,517

[22] Filed: Jul. 11, 1990

[30] Foreign Application Priority Data

Jul. 15, 1989 [DE] Fed. Rep. of Germany ..... 3923445
Sep. 9, 1989 [DE] Fed. Rep. of Germany ..... 3930182

[51] Int. Cl.[5] ..... C10L 5/40; C10L 5/06

[52] U.S. Cl. ..... 44/564; 44/591; 44/596; 264/122; 75/766

[58] Field of Search ..... 44/564, 596, 591; 264/122

[56] References Cited

U.S. PATENT DOCUMENTS

| | | | |
|---|---|---|---|
| 3,001,856 | 9/1961 | Reerink et al. | 44/564 |
| 3,308,219 | 3/1967 | Schmalfeld et al. | 44/596 |
| 3,926,576 | 12/1975 | Schmalfeld et al. | 44/568 |
| 3,960,543 | 6/1976 | Schmalfeld et al. | 75/752 |
| 4,345,914 | 9/1982 | Rammler | 44/599 |

FOREIGN PATENT DOCUMENTS 3727464 3/1989 Fed. Rep. of Germany .

*Primary Examiner*—Ellen M. McAvoy
*Attorney, Agent, or Firm*—Herbert Dubno

[57] ABSTRACT

Fuel briquettes are made by blending a caking coal with pitch at a temperature above 100° C. but below 200° C. to form a pitch/coal alloy binder which is then hot-blended with any caking coke, especially petroleum coke and optionally finely-divided limestone. The pressed briquettes are then subjected to hardening heat treatment and are found to be resistent to mechanical deterioration on long-term storage.

12 Claims, 1 Drawing Sheet

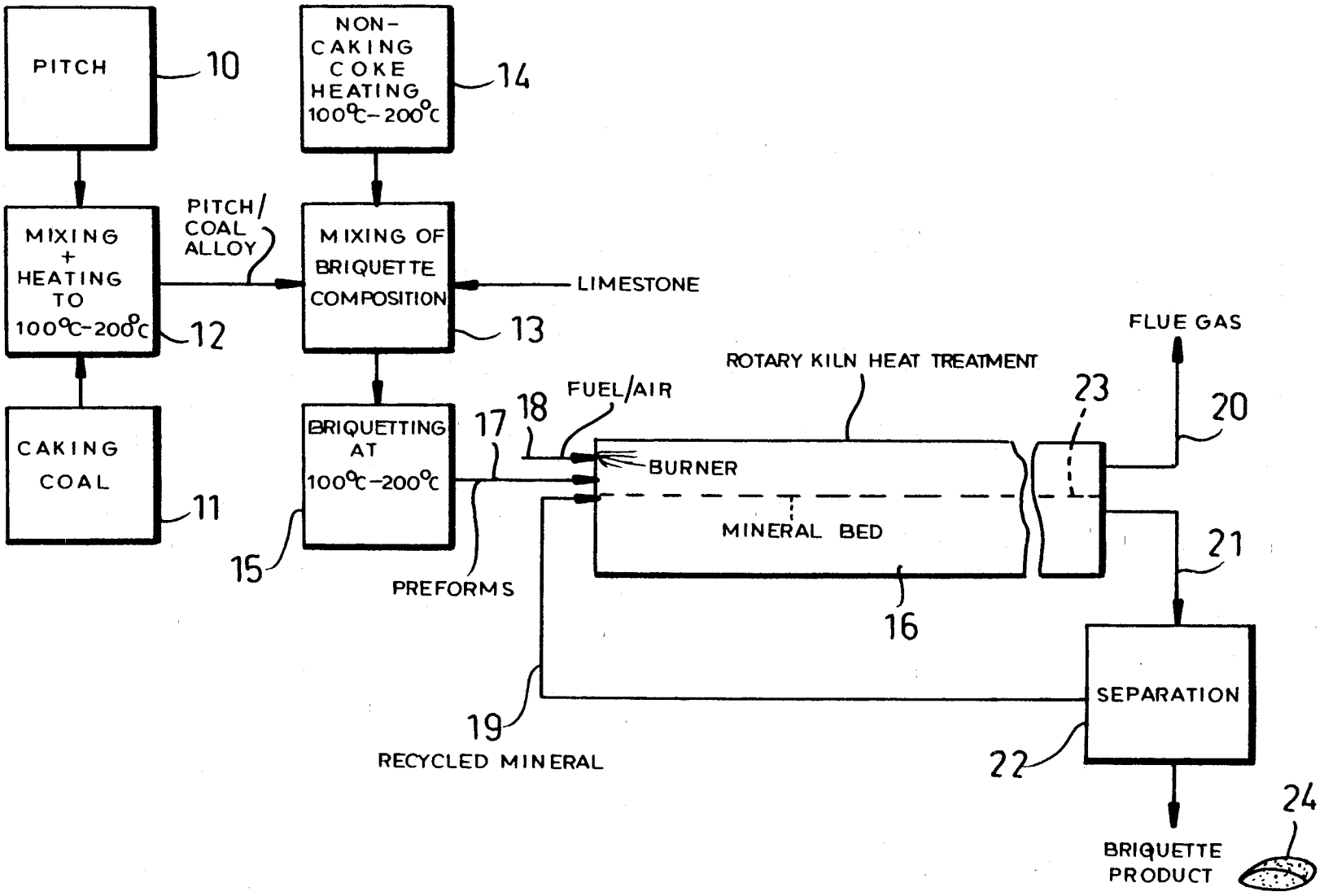
PITCH
10
MIXING + HEATING TO 100°C-200°C
12
CAKING COAL
11
PITCH/ COAL ALLOY
NON-CAKING COKE HEATING 100°C-200°C
14
MIXING OF BRIQUETTE COMPOSITION
13
LIMESTONE
BRIQUETTING AT 100°C-200°C
15
PREFORMS
17
18
FUEL/AIR
BURNER
ROTARY KILN HEAT TREATMENT
MINERAL BED
16
23
FLUE GAS
20
21
SEPARATION
22
BRIQUETTE PRODUCT
24
RECYCLED MINERAL
19

METHOD OF MAKING FUEL BRIQUETTES AND THE BRIQUETTES SO MADE

Field of the Invention

My present invention relates to a method of making fuel briquettes, especially for heating purposes, and to the briquettes which are thus formed. More particularly, the invention relates to the production of fuel briquettes utilizing a noncaking fine-grained carbon carrier, preferably petroleum coke, and a pitch-containing binder such that, after the binder is mixed with the carbon carrier, the resulting mixture is subjected to briquetting to form the green briquettes and the green briquettes are then subjected to a heat treatment for hardening and stabilization.

BACKGROUND OF THE INVENTION

In my prior German patent document DE 37 27 464, I have described a process for producing fuel briquettes from a noncaking fine-grained carbon carrier and a pitch-containing binder in which a coke, especially petroleum coke in a sand-fine particle size range of 0.05 to 2 mm, is used. The sand-fine carbon carrier can also be composed of or can contain noncaking coal.

The fuel briquettes fabricated by this process must satisfy all of the physical requirements for such briquettes, i.e. must have sufficient stability and strength to withstand transport and storage and must remain intact during combustion. Further, they should neither burn too strongly nor burn only with a glow-type combustion. These characteristics of the briquette can be established by the compacting pressure during briquetting.

In the process described in DE 37 27 464, by and large the green briquettes, i.e. the preforms which are then fired to produce the final briquettes of sufficient strength, are generally free from caking coal. To the extent fine-grained caking coal is present, the quantity thereof is so small that it plays practically no role in the binder briquetting. The heat treatment is effected in a heated rotary kiln or tube furnace which is filled in its lower portion with sufficient sand-fine coke that the heat treatment is effected in a coke immersion.

This process has been found to be satisfactory. Fuel briquettes which are thus made satisfy all of the requirements for combustion. However, improvements are possible with respect to the long-term storage characteristics of the product. Since it is frequently necessary to store the briquettes for long periods before their combustion, the long-term storage characteristics are of major importance. With the prior art briquettes, it has been found that the mechanical strength diminishes with time and under certain ambient conditions. For example, it has been found that air tends to diffuse into the fuel briquettes and, especially upon storage of the briquettes in the open. Water can likewise penetrate into them reducing the binding strength of the petroleum and the coke binder matrix and thereby allowing mechanical deterioration of the briquettes.

OBJECTS OF THE INVENTION

It is, therefore, the principal object of the present invention to provide a method of making fuel briquettes which can yield a fuel briquette product which is substantially less sensitive to long-term storage even in the open.

Another object of the invention is to provide an improved method of making fuel briguettes so that these briquettes will satisfy all of the mechanical requirements hitherto found to be important and also will have a significantly improved long-term storage capability, even upon storage and transport in the open air, so that the briquettes do not lose strength with such storage.

Still another object of this invention is to provide an improved briquette with the properties described.

SUMMARY OF THE INVENTION

These objects and others which will become apparent hereinafter are attained, in accordance with the present invention in a method which comprises the steps of forming a binder by mixing pitch and caking coal, the latter being present in an effective amount to transform the binder into one which is substantially unaffected by long-term storage of the finished briquettes in open air, and providing a binder mixture at a temperature in excess of 100° C. to 200° C.

The noncaking carbon carrier at a mixing temperature lying in the same temperature range is then mixed with the binder mixture at the aforementioned temperature and the preform is briquetted from the mixture at this mixing temperature.

The preform is then subjected to the hardening heat treatment or firing process.

It will be understood, of course, that the briquetting can be effected at a briquetting temperature which can be somewhat less than the mixing temperature, this lower temperature resulting from the heat loss between mixing and briquetting or in the briquetting process. The briquetting temperature may be, for example, some 50° less than the mixing temperature.

The hardening heat treatment can provide a final temperature in excess of 400° C. for the briquettes although preferably the final briquetting temperature at the hardening heat treatment is in excess of 450° C.

According to the invention, the briquetting by means of which the preforms are made is a binder briquetting of the type known in the art of bituminous coal briquetting. Indeed, conventional binder briquetting techniques may be used with conventional briquetting presses and compression pressures.

Surprisingly, when the binder composition is modified as described and the process modified with respect to the temperatures in the various stages as specified in conjunction therewith, the fuel briquettes have all of the desirable properties of briquettes made in accordance with the teachings of DE 37 27 464 but also significantly improved long-term storage properties, even with storage in the open air.

This is especially the case when the binder mixture forms a pitch-coal "alloy". When reference is made to a pitch-coal "alloy" here, I intend to describe a condition in which the pitch and the caking coal engage in some mutual solubilization so that some of the pitch is dissolved in some of the coal and some of the coal is dissolved in some of the pitch so that the pitch and coal are integrated into a new binder with properties which differ from those characteristic of the pitch and those characteristic of caking coals.

This pitch-coal alloy state is easily achieved when the caking coal which is used is sufficiently finely divided. In the fuel briquettes, the pitch-coal alloy has been found to be insensitive to air and moisture which tends to diffuse into the briquette. Moreover, the binder alloy has been found to be highly reactive with a reactivity equivalent to that of the noncaking carbonaceous material constituting the briquetted substance.

Advantageously the noncaking carbon carrier, for example sand-fine coke, and the binder mixture are brought to the same temperature of approximately 160° C. and are mixed at this temperature.

While in the process of DE 37 27 464, the hardening heat treatment is carried out in a rotary tube furnace, the heat treatment according to the invention can be carried out also in other ways, for example, on a travelling grate in a travelling grate furnace. In the latter case, the briquettes can be carried through a corresponding chamber in one or more layers for the heat treatment.

In a preferred embodiment of the invention, however, the preforms are hardened in a rotary tube furnace. It has been found to be particularly effective both with respect to the convenience of the heat treatment and the obtention of a high final compressive strength, to provide in the rotary tube furnace a mineral bed of a fine-grained mineral material.

Advantageously, the preforms are fabricated with a specific weight (weight per unit volume) controlled by adjustment of the mixing ratio between the binder and noncaking coke and by the compaction of the briquettes so that this specific weight is greater than the piled weight of the fine-grained mineral material used in the bed.

As a consequence, when these preforms are introduced into the heated rotary tube furnace for the purposes of hardening heat treatment and the furnace is filled with the fine-grained mineral material to a sufficient depth, the heat treatment of the preforms will be effected in an immersion bed.

A fine-grained mineral material advantageously has a temperature of about 500° C. to about 530° C. at least in the region of the discharge end of the rotary tube furnace.

The rotary tube furnace advantageously is so filled with the fine-grained mineral material that the volume of mineral material is greater than twice the interstitial volume of a lose pile of the preforms.

Of course, the invention can also use the technology described in DE 37 27 464 with respect to the hardening heat treatment. The fine-grained mineral substance can be sand, expanded or foamed perlite or vermiculite, or fine-grained petroleum coke when the furnace atmosphere is such as to prevent combustion thereof.

In any case an effort should be made that at the beginning of the heat treatment, the preforms are subjected to a temperature which drives the very rapidly volatilized component from the preforms so that the expelled gases and vapors can protect the bed and the preforms from oxidation in the balance of the rotary tube furnace.

According to the invention, the composition of the briquette is based upon the starting mixture from which the preforms are briquette and comprises between 68 and 81% by weight of the noncaking carbonaceous carrier, generally petroleum coke with a particle size of less than 2 mm and preferably having at least 604 by weight less than 0.5 mm. The particle size range of this component can range from 0.05 mm to 2 mm.

The other component, making up 19 to 32% by weight of the starting mixture for producing the preforms, comprises the binder component. The composition can also contain 3 to 6% by weight of limestone. The limestone should have a particle size less than 0.5 mm and preferably ranging between 0.05 and 0.5 Mm.

The binder component advantageously comprises at least 7% by weight (of the starting composition for producing the preforms) of pitch in the form of coal or petroleum pitch, especially so-called electrode pitch. It should also contain at least 12% by weight (based upon the starting composition for producing preforms) of fine-grained caking coal. Preferably the binder mixture comprises 7 to 12% by weight pitch and 12 to 144 by weight of the fine-grained caking coal.

The fuel briquettes of the invention are characterized by long-term storage properties and retention of their mechanical properties from long-term storage through transport to combustion in the furnace. The limestone is added as a combustion inhibitor to regulate the rate of combustion.

The fuel briquettes can also be used in a cupola furnace as a carbon carrier in the production of cast iron.

BRIEF DESCRIPTION OF THE DRAWING

The above and other objects, features and advantages of the present invention will become more readily apparent from the following description, reference being made to the accompanying drawing, the sole FIGURE of which is a flow diagram illustrating the method of the invention.

SPECIFIC DESCRIPTION

In the drawing, I have shown a process in which pitch supplied at 10 and caking coal supplied at 11 to the mixing and heating stage 12 are intimately blended into a pitch/coal alloy as defined above and in which the composition is brought to a temperature in excess of 100° C. to a temperature of 200° C. The caking coal can have a fine-grain form with a particle size of less than 0.5 mm and advantageously ranging from 0.01 Mm to 0.25 Mm in grain size.

The pitch/coal alloy as described above is fed to a mixing stage 13 which is also maintained at an elevated temperature above 100° C. and preferably about 160° C. for the entire duration of the mixing operation. In stage 13, the pitch/coal alloy constituting the binder is blended with noncaking coke heated previously to the same temperature as the binder and, if desired, with limestone.

The resulting composition is subjected to hot briquetting at a temperature above 100° C. and preferably no more than about 50° C. below the temperature at which the binder was admixed with the noncaking coke. The noncaking coke is preferably petroleum coke.

From the hot briquetting stage 15, the preforms are fed to a hardening heat treatment which, in the embodiment shown, is a rotary kiln heat treatment.

The rotary kiln treatment is carried out in a rotary kiln 16 in which a mineral bed 23 is maintained under the conditions described so that, when the preforms are fed to the bed, they are immersed therein. The kiln is fired with a fuel-air mixture introduced at 18 to a burner and the volatiles generated from the briquettes upon their initial contact with the heated mineral substance of the bed, form a protective atmosphere which traverses the kiln and is discharged as a flue gas at 20.

The mineral substances and the hardened briquettes are removed at the opposite end of the kiln at 21, subjected to separation at 22 and the briquettes are recovered as shown for the briquette 24. The mineral substances are recycled at 19 to the bed.

SPECIFIC EXAMPLE

Utilizing an apparatus as shown in the drawing, a binder is prepared from 10% electrode pitch and 13% of fine-grained caking coal with a particle size of 0.05 to 0.2 Mm. The pitch and caking coal are heated to 160° C. and blended until an intimate composition is formed in which pitch and caking coal in the apparatus can no longer be separately distinguished. This binder is then combined with 4% lime (particle size about 0.5 mm) and with 70% noncaking petroleum coke of a particle size range of 0.05 to 2 mm of which 65% has a particle size below 0.5 mm. The noncaking petroleum coke and the limestone are each previously heated to 160° C. and the resulting mixture is formed at 160° C.

Preforms are hot-pressed as briquettes form the resulting mixture and are introduced into the rotary kiln shown in the drawing.

The temperature of the sand bed in the rotary kiln is maintained at 520° C. and the hardened briquettes emerge at this temperature, are separated from the sand, and are cooled. The cooled briquettes can be stored for weeks in the open air without mechanical degradation in spite of the diffusion of moisture and oxygen into the briquettes. They burn with properties analogous to those obtained with the briquettes made in accordance with DE 37 27 464.

I claim:

1. A method of making fuel briquettes through bituminous coal briquetting, especially for heating purposes, comprising the steps of:

(a) preparing a pitch-containing binder which is a pitch/coal alloy by mixing pitch and caking coal at a temperature in a range in excess of 100° C. and up to 200° C;

(b) mixing said binder with a noncaking carbon carrier which is a coke at a temperature in said range to form a briquetting composition, the amount of pitch in said alloy being 7 to 12 percent by weight of the composition and the amount of the caking coal in the alloy being 12 to 14 percent by weight of the composition;

(c) pressing briquette preforms from said composition; and (d) heat-treating said briquette preforms to harden same, thereby forming fuel briquettes retaining mechanical strength after long-term storage.

2. The method defined in claim 1 wherein said noncaking carbon carrier and said binder are at the same temperature upon mixing to form said composition.

3. The method defined in claim 2 wherein said same temperature is about 160° C.

4. The method defined in claim 1 wherein said preforms are heated in step (d) in a mineral bed of fine-grained mineral substance in a rotary tube furnace.

5. The method defined in claim 4 wherein said preforms are pressed in step (c) with a specific weight greater than a piled weight of said fine-grained mineral substance and wherein said rotary tube furnace is filled sufficiently with said fine-grained mineral substance that said preforms are immersed in said bed during the heat treatment thereof in step (d).

6. The method defined in claim 5 wherein said rotary tube furnace is so filled with said fine-grained mineral substance that a volume of said fine-grained mineral substance is greater than twice an interstitial volume of a loose pile of said preforms.

7. The method defined in claim 1 wherein said binder comprises at least 7% of said composition by weight of pitch in the form of coal or crude oil pitch and at least 12% by weight of said composition has fine-grained caking coal.

8. The method defined in claim 7 wherein said pitch is electrode pitch.

9. The method defined in claim 7 wherein said composition contains 3 to 6% thereof by weight limestone.

10. The method in claim 1 wherein said noncaking coke is a noncaking petroleum coke.

11. The method defined in claim 10 wherein said noncaking petroleum coke has a grain size less than 2 mm and at least 60% by weight of which has a grain size below 0.5 mm, said limestone having a grain size less than 0.5 mm.

12. Fuel briquettes made by the method of claim 1.

* * * * *